United States Patent [19]

Koch

[11] 4,410,145

[45] Oct. 18, 1983

[54] STONE CRUSHER

[75] Inventor: Manfred Koch, Neustadt, Fed. Rep. of Germany

[73] Assignee: IBAG-Vertrieb GmbH, Neustadt, Fed. Rep. of Germany

[21] Appl. No.: 143,168

[22] Filed: Apr. 23, 1980

[30] Foreign Application Priority Data

Apr. 24, 1979 [DE] Fed. Rep. of Germany ..... 2916513

[51] Int. Cl.[3] ..... B02C 1/02; B02C 19/08

[52] U.S. Cl. ..... 241/264; 241/207; 241/283

[58] Field of Search ..... 241/1, 207, 211, 213, 241/262, 263, 264, 266, 283, 301

[56] References Cited

U.S. PATENT DOCUMENTS

| | | | |
|---|---|---|---|
| 2,609,994 | 9/1952 | Gauldie | 241/264 X |
| 3,099,406 | 7/1963 | Kautz | 241/266 X |
| 3,125,303 | 3/1964 | Mc Carty et al. | 241/213 |
| 3,284,010 | 11/1966 | Bodine, Jr. | 241/1 X |
| 3,460,766 | 8/1969 | Sarapuu | 241/301 X |
| 4,016,630 | 4/1977 | Bengtsson et al. | 241/213 X |
| 4,026,481 | 5/1977 | Bodine | 241/266 |
| 4,131,238 | 12/1978 | Tarpley, Jr. | 241/1 X |

*Primary Examiner*—Howard N. Goldberg
*Attorney, Agent, or Firm*—Orville N. Greene

[57] ABSTRACT

Rocks are known to contain minute cracks and fissures and such rocks can be crushed under less force than the ordinary crushing force when a vibrational force is applied to exert tension at the cracks and fissures. Rock crushers of the type which include hydraulic means connected to a crushing member are improved by adding means for superposing a vibratory force into hydraulic circuits of such crushers.

1 Claim, 4 Drawing Figures

1
2
3
4
5
6
7
8
9
10
11
12
13
14
15
16
17
18
M
P

STONE CRUSHER

The invention relates to a pulverizing machine for stones, as for example, a cone crusher or a jaw crusher. Such machines have a hydraulic or mechanical drive. With one known cone crusher of this type with mechanical drive, a hydraulic support is provided for the crushing cone, which also can serve for the regulation of the crushing slit and as usual has overload protection.

This invention is based on the problem of building a crushing machine of this type which through the production of vibration waves which are superposed on a crushing tool movement, an improved and efficient pulverization in the machine for treatment of stones will be produced. It is known that the stone to be crushed is thoroughly permeated with hairline and cleavage cracks and that by the application of high frequency vibrations, through suitable produced tension, to break the stone bodies at the surface of the said fissures.

The invention solves this problem in crushing machines having a hydraulic circuit for a hydraulically driven crusher, with mechanical drive having a hydraulic circuit for supporting the crushing tool, by connecting or adding to said hydraulic circuit, a vibration wave impressing means from a vibration source.

The vibration source can preferably be developed as a cylinder connected to the hydraulic system whereby the stroke of the piston moving in the cylinder fixes the vibration stroke and the frequency thereof.

It is also possible to provide a variable speed pump in the hydraulic circuit as the vibration producing means. This piston pump can create an intermediate oil column of suitable stroke and suitable frequency.

Finally, a correspondingly developed valve control means coupled with an outside hydraulic reserovir can be provided for the development of the vibrations of the desired frequency and amplitude.

All of these means of control can be provided directly in the hydraulic circuits of the drives of those machines with hydraulic drives.

Further features of the invention and details of the same which provide additional advantages will be apparent from the following description of the figures in the accompanying drawings which show by way of example and schematically, embodiments of the subject matter of the invention.

Figures 1, 1A:
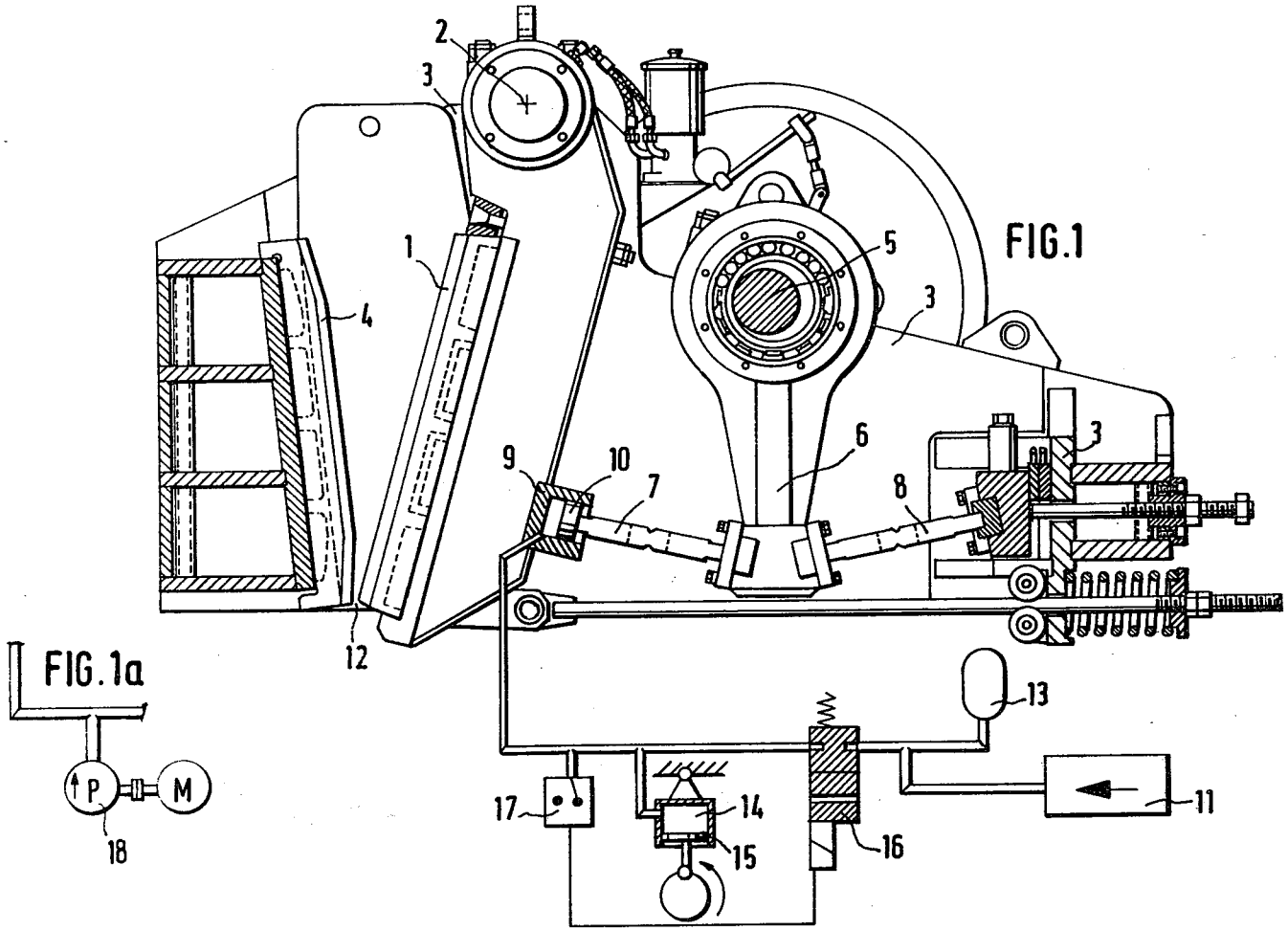

FIG. 1 shows the concerned structural parts of a double-joint-lever-jaw crusher with the vibration producing part in the hydraulic circuit.

FIG. 1*a* shows an alternative embodiment of the vibration producer.

Figure 2:
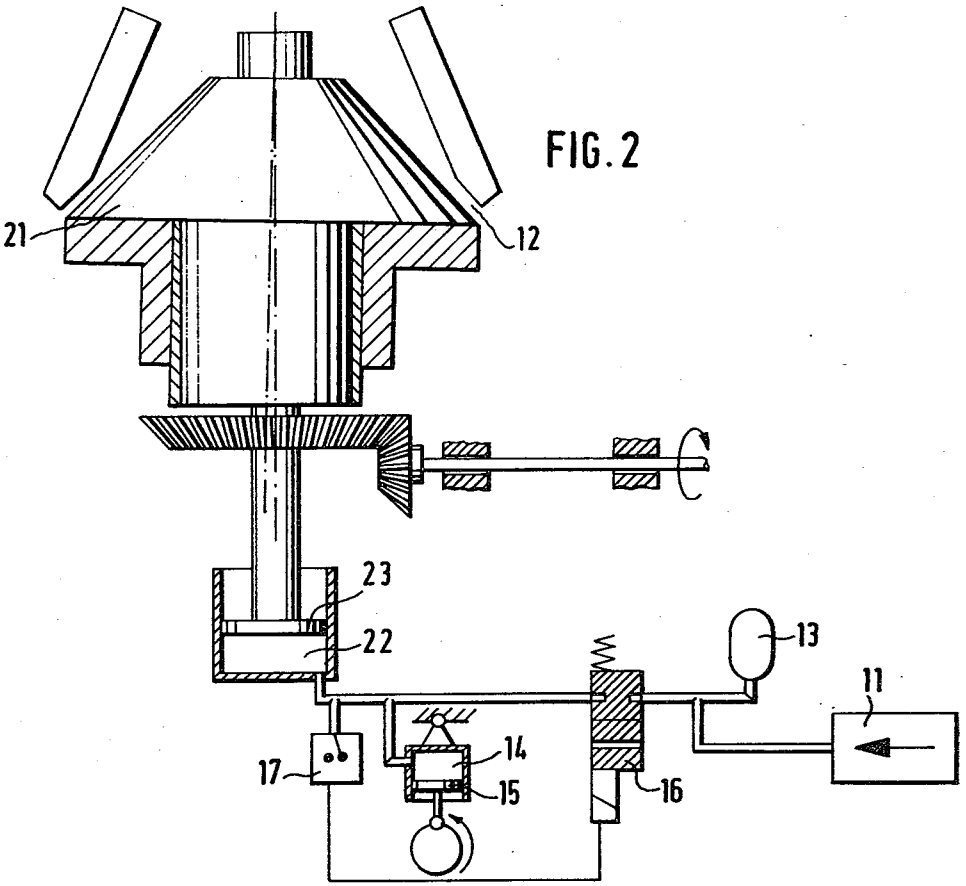
Figure 2A:
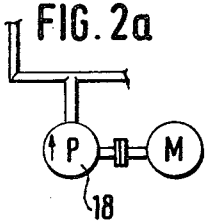

FIG. 2 shows an addition example of a cone crusher with a vibration producer and in FIG. 2*a* there is provided a corresponding modification of a vibration producer for FIG. 2.

The crusher jaw 1 of FIG. 1 is attached on swingable swivel axis 2 positioned on the machine part 3 and is moved toward and away from the fixed counter jaw 4. The drive of jaw 1 is by a usual and known way, by means of an eccentric drive 5 through a cam 6 and the two pressure plates 7 and 8 whereby the pressure plate 7 of the jaw 1 moves and the pressure plate 8 is supported on a backrest.

A cylinder 9 with a piston 10 can now be provided on the crusher jaw 1 which can be filled with a more or less viscous material from a pressure source 11 so that a regulation of the crusher slot 12 can be attained. Simultaneously the cylinder 9 with the help of an accumulator 13 provided in the hydraulic circuit serves as security against overloading.

It is already known, that stone by virtue of the always present hairline and cleavage cracks can be pulverized not only by continuous pressure exerted at intervals, but that beyond that a splitting occurs through vibrative action in the region of the fissures.

In order now to be able to superpose a sufficiently high frequency vibration on the movement of the jaw 1, the invention provides for the control of a vibration producer in the form of a cylinder 14 with a piston 15 in the hydraulic circuit. In order to allow these vibration waves to reach the jaw 1 without loss, an electromagnetic control valve 16 is so connected into the hydraulic circuit that the accumulator 13 and the pressure source 11 are separated. The valve 16 is controlled from a pressure switch 17 to reach a certain preadjustable pressure. The vibration produced in the cylinder 14 through the piston 15 is conducted to the cylinder 9 on the crushing jaw 1 and this reaches to the crushed stone through the movement of the jaw.

In a similar way, as shown in FIG. 2, a cone crusher can be built. Here, a breaking cone 21 executes a tumbler movement around a vertical axis. The breaking cone 21 is supported hydraulically from below by means of a cylinder 22 and a piston 23. With this equipment a regulation of the crushing slit can simultaneously be accomplished. Also here again a pressure source 11 and an accumulator 13 for the hydraulic means is provided for security against overloading, as above. The vibration transmission to the stone results as in the above-described jaw crusher.

In the FIGS. 1*a* and 2*a* an alternative embodiment of the vibration production in the hydraulic circuit is shown. Here a piston pump 18 is provided which is adjustable with respect to its length of strokes and number of strokes.

A further modification is obvious, i.e. by the insertion of a hydraulic reservoir and a control valve. For charging of such reservoirs there is provided a hydraulic pump from a pressure control suitable to the energy consumed.

I claim:

1. A machine for crushing stones of the type having hairline and cleavage cracks susceptible to propagation by high frequency vibration; said machine being of the type having a crushing chamber defined by two members each having a top edge, a bottom edge and a crushing surface which extends between the top and the bottom edges; the two members being mounted in the machine such that their crushing surfaces face each other, the space between their top edges form an entrance opening to the chamber and the space between their bottom edges form a discharge opening from the chamber and in which one of said members is mounted for movement towards and away from the other member to effect a mechanical crushing of material which has been fed between the two members;

further including means for regulating the size of the discharge opening, said means for regulating comprising a hydraulic cylinder and a piston and hydraulic medium in the cylinder, one of the hydraulic cylinder or the piston being directly attached to the movable member and the other of the hydraulic cylinder or piston being mounted for movement relative to the movable member, the improvement comprising means connected to said hydraulic cylinder for supplying said hydraulic medium thereto and means for superimposing a relatively high frequency vibration on the movable member, as the movable member is moving toward and away from the other member, for propagating the hairline and cleavage cracks of the rocks;

said means for superimposing comprises means for producing relatively high frequency vibrations in the hydraulic medium which are transmitted to the movable member via the piston or cylinder which is directly attached to the movable member.

* * * * *